US005215073A

United States Patent [19]

Wilson

[11] Patent Number: 5,215,073

[45] Date of Patent: Jun. 1, 1993

[54] INSULATION SYSTEM FOR DOMESTIC RANGES

[75] Inventor: Arthur C. Wilson, Louisville, Ky.

[73] Assignee: General Electric Company, Louisville, Ky.

[21] Appl. No.: 890,090

[22] Filed: May 29, 1992

[51] Int. Cl.[5] ..... A21B 1/00

[52] U.S. Cl. ..... 126/19 R; 126/273 R; 219/391

[58] Field of Search ..... 126/19 R, 21 R, 273 R, 126/273 A; 219/391, 392, 408, 409

[56] References Cited

U.S. PATENT DOCUMENTS

| | | | |
|---|---|---|---|
| 2,375,047 | 5/1945 | Sutherland | 126/21 |
| 3,033,188 | 5/1962 | Cline et al. | 126/273 |
| 3,053,963 | 9/1962 | Dills | 219/35 |
| 3,328,560 | 6/1967 | Dills | 219/391 |
| 3,329,529 | 7/1967 | Lamar | 134/22 |
| 3,499,431 | 3/1970 | McArthur, Jr. | 126/39 |
| 3,882,843 | 5/1975 | Barnett | 126/273 A |
| 4,163,894 | 8/1979 | Scherer | 219/391 |
| 4,241,718 | 12/1980 | Barnett | 126/21 R |
| 4,598,691 | 7/1986 | Herrelko et al. | 126/41 R |
| 4,796,600 | 1/1989 | Hurley et al. | 126/273 H |
| 4,865,010 | 9/1989 | Kett | 126/21 R |

*Primary Examiner*—Carroll B. Dority

[57] ABSTRACT

An improved arrangement for insulating the oven liner in a domestic range in which a single batt of insulating material is wrapped around the top, bottom and side walls of the oven liner such that the opposite end portions of the batt overlap each over the entire top wall of the oven liner to provide a double layer of insulation over the top wall and a single layer over the side and bottom walls. The batt is held in place by the oven exhaust vent stack which pierces both overlapping layers. The use of the vent stack for this purpose, together with the reduced thickness of the batt covering the side walls, eliminates the need for bands to secure the batt.

7 Claims, 2 Drawing Sheets

INSULATION SYSTEM FOR DOMESTIC RANGES

BACKGROUND OF THE INVENTION

The present invention relates in general to domestic range appliances and more particularly to the manner of insulating the oven in such appliances.

It is well known in the range art to provide a layer of thermal insulation around the oven liner to contain thermal energy within the oven and to maintain acceptable surface temperatures for the external surfaces of the range and particularly for the cooktop area. A commonly used technique for insulating the oven liner involves wrapping a batt of fiberglass insulating material around the liner to provide a uniformly thick layer of insulation around the oven liner. For ease of assembly and to allow for manufacturing tolerances in insuring complete coverage of the oven liner, it is common for the length of the batt to be slightly greater than the circumference of the oven liner with the result that the opposing ends of the batt may overlap slightly, typically above the middle of the top wall of the oven liner.

Since the broiler element is disposed proximate the top wall of the oven liner and since the surface temperature for the cooktop surface must be maintained within relatively low limits, the area directly above the oven liner presents the greatest need for insulation. Consequently, the thickness of the batt of insulation is chosen to satisfy the insulation requirements for this area. Steel bands are typically employed to hold the batt in place and to insure sufficient clearance between the insulation and the side panels of the range body for adequate convection cooling air flow therebetween.

The use of a single batt of fiberglass insulation to provide a layer of uniform thickness over the top sides and bottom of the oven liner provides satisfactory insulating performance and lends itself to efficient assembly techniques. However, selecting the thickness of the batt to satisfy the insulation requirements for area above he oven liner results in using more insulation than is necessary, since the insulation requirements are not necessarily uniform around the entire periphery of the oven liner. In addition the use of steel bands to hold the insulation in place adds material cost and complexity to the assembly process.

It would be desirable therefore to provide an improved method and apparatus for insulating the oven liner in range appliances which preserves the advantages of using a single batt of insulating material, while overcoming the aforementioned shortcomings of the prior art.

SUMMARY OF THE INVENTION

In accordance with the present invention a range cooking appliance of the type having a cooktop which supports surface heating units for surface cooking and an oven cooking cavity defined by an oven liner having a top wall, a bottom wall, two side walls, a rear wall and an open front face, and further including an exhaust vent stack projecting upwardly from the top wall of the oven liner to conduct exhaust gases from the cooking cavity, is provided with an improvement wherein the insulation surrounding the top, side and bottom walls of the oven liner comprises a single batt of fiberglass insulating material wrapped around the oven liner such that the batt overlaps itself over substantially the entire top wall of the oven liner, thereby covering the side and bottom walls of the oven liner with a single thickness of the fiberglass batt, and covering the top wall of the oven liner with a double thickness of the batt. After the batt is properly wrapped around the oven liner with the opposing end portions overlapping, a hole is pierced in each of the opposing end portions of the batt by insertion of the vent stack through an opening in the top wall of the oven liner. By this arrangement the stack acts as a stake to secure the batt in place.

By this arrangement the thickness of the batt may be reduced to approximately one-half of the thickness needed in the region above the top wall of the oven liner. Hence the thickness of the batt is substantially less than that typical of the prior art. The reduced thickness of the insulation between the side walls of the oven liner and the range body side panels, together with use of the vent stack to hold the batt in place eliminates the need for the steel bands conventionally used to secure the batt to the oven liner.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings, in which:

DETAILED DESCRIPTION OF THE ILLUSTRATIVE EMBODIMENT

Figure 1:
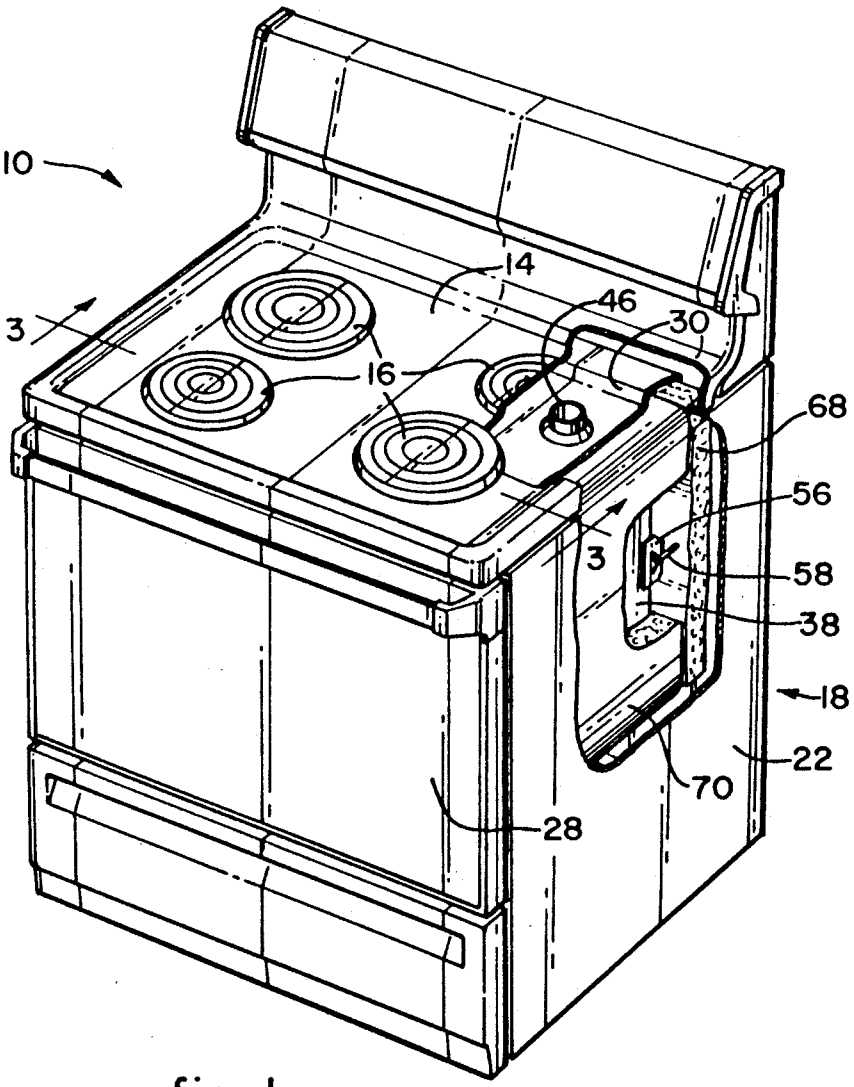
FIG. 1 is a perspective view, with portions cut away of a free-standing range appliance illustratively embodying the improvement of the present invention.
Figure 4:
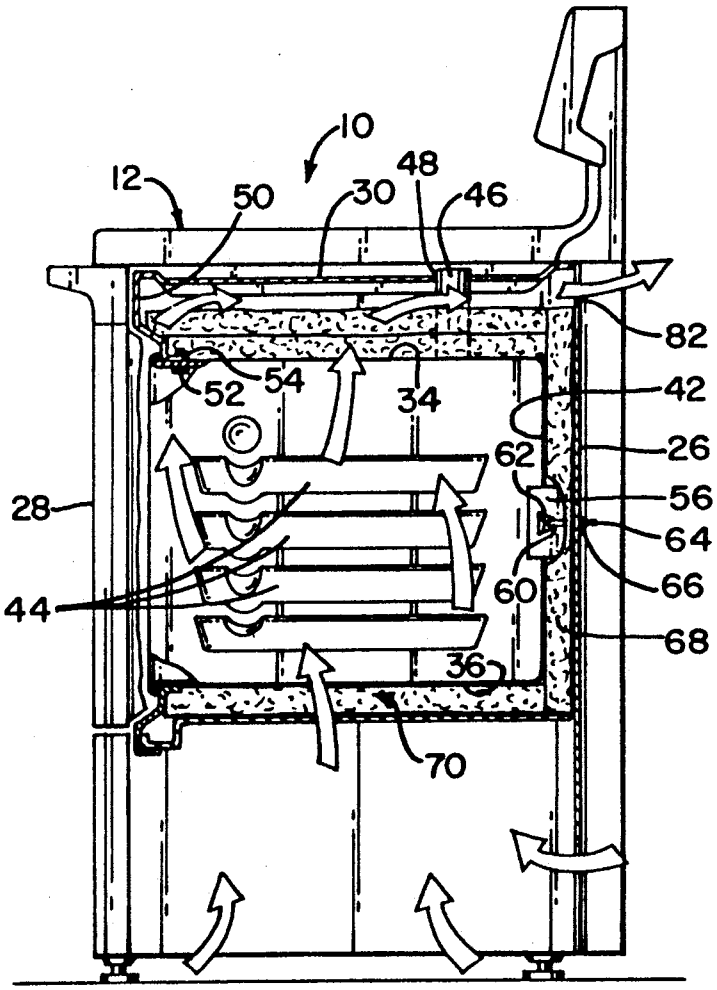
FIG. 4 is a simplified schematic side elevational view of the range of FIG. 1 with the range body partially in section and with portions cut away.
Figure 3:
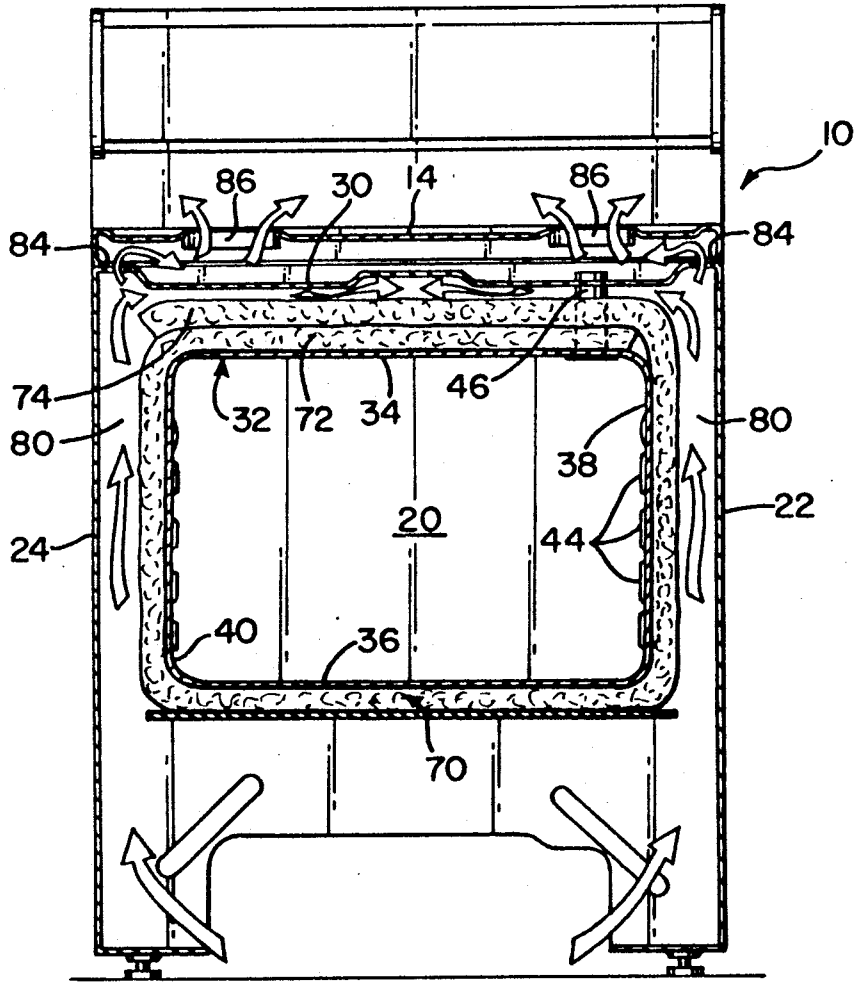
FIG. 3 is a simplified schematic front elevational cross sectional view of the range of FIG. 1 taken along lines 3—3 with the surface units removed.

Turning to a consideration of the drawings there is shown in FIGS. 1, 3 and 4, an electric range 10 having a cooktop portion 12 including a cooktop surface 14 with a plurality of electric sheathed resistance surface heating units 16 supported therefrom. Cooktop portion 12 is supported from a range body 18 which contains a cooking oven cavity 20. The range body 18 comprises a pair of opposing side panels 22 and 24, a rear panel 26 and an oven door 28, which covers the front opening of the oven 20. A subtop 30 supported from the upper edges of the side panels 22 and 24 extends beneath the cooktop surface 14 to contain spills.

Figure 2:
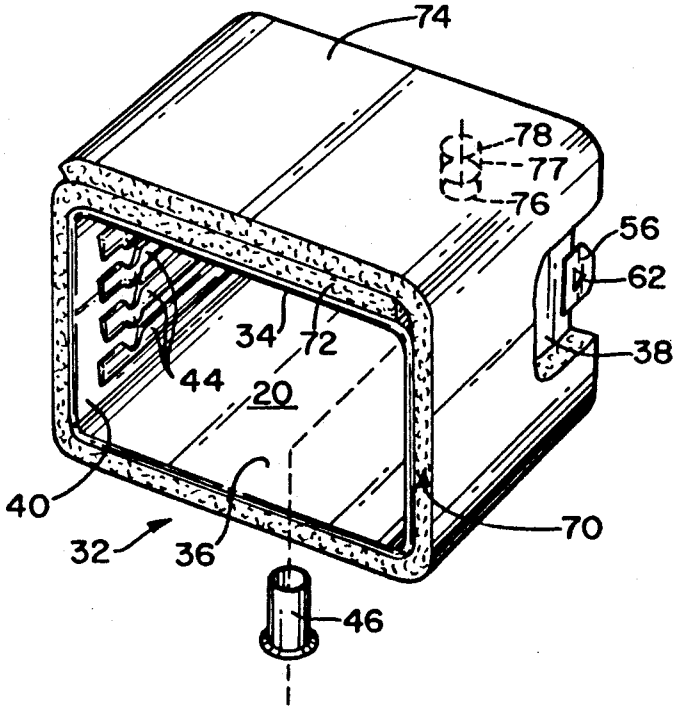
FIG. 2 is a perspective view of the oven liner and insulation removed from the range of FIG. 1.

As best seen in FIGS. 2–4, the front opening oven cooking cavity 20 is defined by an oven liner 32. The oven liner 32 is a generally rectangular box-like structure having a top wall 34, a bottom wall 36, two side walls 38 and 40, and a rear wall 42. The front face of the oven liner 32 is open to permit access to the cooking cavity 20. Embossments 44 formed in the side walls 38 and 40 define grooves to support sliding oven racks (not shown) at various different heights within the oven cavity 20.

An exhaust vent stack 46 is suitably mounted in conventional fashion in an opening formed in the top wall 34 of the oven liner 32. The upper end of the vent stack 46 extends upwardly through an opening 48 formed in the subtop 30 beneath the right rear surface unit 16.

Exhaust gases generated in the oven cavity 20 exit to the atmosphere via the vent stack 46.

The oven liner 32 is supported within the range body 18 near the front thereof from the front frame 50 of range body 18 and in the rear from the rear panel 26. More specifically the oven liner 32 is attached to the front frame 50 by a screw 52 which attaches the top wall 34 of the oven liner 32 near its front edge to a flange 54 extending rearwardly from the front frame 50. Rear support of the oven liner is provided by a pair of sheet metal support tabs 56 (one of which is visible in FIGS. 1, 2 and 4) each of which is suitably secured as by welding to its corresponding one of oven liner side walls 38 and 40 near the rear edge thereof and extending rearwardly therefrom. Each of these tabs 56 is attached to the rear panel 26 of the range body 18 by a corresponding hookbolt 58. The hook end 60 of the hookbolt 58 is received in the opening 62 formed in the support tab 56 for this purpose. The threaded 64 end of the hookbolt 58 extends through the rear panel 26 and is secured in place by a nut 66.

Insulation for the rear wall 42 of the oven liner 32 is provided in conventional fashion by a batt 68 of fiberglass insulation which fills the space between the oven liner rear wall 42 and the rear panel 26 of the range body 18.

In accordance with the present invention insulation for top, bottom and side walls 34, 36, 38 and 40 respectively, of the oven liner 32 is provided in the form of a single batt 70 of fiberglass insulating material. As best seen in FIG. 2, batt 70 is wrapped around the top, bottom and side walls 34, 36, 38 and 40 respectively, of the oven liner 32 such that one end portion 72 of the fiberglass batt 70 overlies substantially the entire outer surface of top wall 34 of the oven liner 32 and the other end portion 74 of the fiberglass batt 70 overlaps the one end portion 72 also substantially over the entire top wall of the oven liner 32, thereby providing a double thickness of insulating material between the top wall 34 of the oven liner 32 and the subtop 30 of the range body 18.

In accordance with another aspect of the invention, the fiberglass batt 70 is held in place by the exhaust vent stack 46 which pierces the overlapping batt end portions 72 and 74. Referring again to FIG. 2, the oven liner insulation assembly process involves first wrapping the batt 70 around the periphery of oven liner 32 with end portions 72 and 74 overlapping above the top wall 34 as hereinbefore described. The stack 46 is then inserted in an opening 76 formed in the top wall 34 of the oven liner 32 for that purpose. As the stack 46 is inserted it pierces the end portions 72 and 74 forming holes through both layers at the locations shown in phantom at 77 and 78 respectively. A bullet shaped fixture (not shown) may be temporarily inserted in the open upper end of stack 46 prior to insertion of stack 46 through the inner liner opening 76 to facilitate the piercing of the batt 70 by the stack 46. The fixture would then be removed.

Use of a fiberglass batt of appliance insulation of the type readily commercially available from various manufacturers, having a thickness of approximately 1 inch for standard ranges and 1½ inches for self-cleaning ranges for batt 70 has been found to provide satisfactory results, effectively containing the thermal energy within the oven cavity and maintaining reasonable external surface temperatures on the range body outer surfaces and cooktop surface.

In the heat management system for the range 10, convective air flow is employed in combination with the oven insulation. The convection air flow paths for the range 10 are illustrated by the arrows in FIGS. 3 and 4. As shown in these FIGS., cooling air is drawn by convection from outside the range 10 into the area beneath the oven liner 32. This cooling air then moves upwardly toward the cooktop 12 through the area designated generally 80, between the batt 70 and the side panels 22 and 24 of the range body 18. Near the top of the side panels 22 and 24, the cooling air splits into two paths. One path enters the area above the batt 70 and beneath the subtop 30 and exits out the back of the range through openings 82 formed in the rear panel 26 of the range body 18 for this purpose. The other path passes through slots 84 in subtop 30 into the area above the subtop 30 and beneath the cooktop surface 14, and exits through surface unit openings 86 formed in cooktop surface 14 to receive the surface units 16. The reduced thickness of batt 70 provides ample clearance between the batt 70 and the inner surface of the side wall panels 22 and 24 to permit convective cooling air to flow up along the side panels 22 and 24 without need for the bands conventionally used to secure the insulating material to the oven liner.

The method of insulating the oven liner in accordance with the present invention, comprising the steps of wrapping a single batt 70 of fiberglass insulation completely around the oven liner 32 with opposing end portions 72 and 74 of the batt 70 overlapping each other over substantially the entire top wall 34 of the oven liner 32, to provide a single thickness of insulating material over the bottom and side walls 36, 38 and 40 respectively, of the oven liner 32, and a double thickness of insulating material over the top wall 34 of the oven liner 32, and piercing the overlapping end portions 72 and 74 of the batt 70 with the vent stack 46 to lock the batt 70 in place, retains the advantageous simplicity of assembly inherent in conventional assembly processes using single a batt of fiberglass, while providing a significant improvement over such conventional processes by reducing the amount of fiberglass used and eliminating the use of bands to hold the batt in place.

While a specific embodiment of the present invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

I claim:

1. In a range cooking appliance of the type having a cooktop supporting surface heating units for surface cooking and an oven liner having a top wall, a bottom wall, two side walls, a rear wall and an open front face defining a front opening oven cooking cavity, and further including an exhaust vent stack projecting upwardly from the top wall of the oven liner to conduct exhaust gases from the cooking cavity, the outer surface of the oven liner being substantially surrounded by thermal insulation, the improvement wherein the insulation surrounding the top, side and bottom walls of the oven liner comprises a single batt of fiberglass insulating material wrapped around the oven liner such that said batt overlaps itself over substantially the entire top wall of the oven liner, thereby covering the side and bottom walls of the oven liner with a single thickness of said batt, and covering the top wall of the oven liner with a double thickness of said batt.

2. The improvement of claim 1 wherein said vent stack pierces through the double thickness of said batt to hold said batt in place.

3. In a range cooking appliance of the type having a cooktop supporting surface heating units for surface cooking supported by a range body comprising opposing side panels joined at the rear by a rear panel, and further including an oven liner contained within and supported from the range body having a top wall, a bottom wall, two side walls, a rear wall and an open front defining a front opening oven cooking cavity, and further including an exhaust vent stack projecting upwardly from the top wall of the oven liner through the cooktop to conduct exhaust gases from the cooking cavity, the outer surface of the oven liner being substantially covered by thermal insulating material, the improvement wherein the thickness of the insulating material surrounding the side and bottom walls of the oven liner is approximately one half of the thickness of the insulating material covering the top wall of the oven liner whereby increased air space is provided between the side wall insulation and the range body side panels for cooling air flow therebetween.

4. The improvement of claim 3 wherein the insulation surrounding the top sides and bottom walls of the oven liner comprises a single batt of fiberglass insulating material wrapped around the oven liner such that said batt overlaps itself over substantially the entire top wall of said oven liner, the side and bottom walls of the oven liner being covered by a single thickness of said batt thereby providing a double thickness of insulating material over the top wall of the oven liner.

5. The improvement of claim 4 wherein said vent stack pierces through the double thickness of said batt to hold said batt in place.

6. A method of insulating the oven liner for a kitchen range appliance the oven liner having an a top wall, a bottom wall, two side walls and a rear wall, and an open front defining a front opening oven cooking cavity, and an exhaust vent stack projecting upwardly from the top wall of the oven liner to conduct exhaust gases from the cooking cavity, said method comprising the step of wrapping a single batt of fiberglass insulation completely around the oven liner with opposing end portions of the batt overlapping each other over substantially the entire top wall of the oven liner to provide a single thickness of insulating material over the side and bottom walls of the oven liner and a double thickness of insulating material over the top wall of the oven liner.

7. The method of claim 6 further comprising the step of piercing the overlapping end portions of said batt with the vent stack to lock the batt in place.

* * * * *